US009353739B2

(12) United States Patent
Wilson et al.

(10) Patent No.: US 9,353,739 B2
(45) Date of Patent: May 31, 2016

(54) MULTI-PRESSURE GAS COMPRESSOR HAVING SIMULTANEOUS RUNNING AND CHARGING SYSTEMS

(71) Applicant: Stanley Fastening Systems, L.P., North Kingstown, RI (US)

(72) Inventors: Christina Wilson, Jackson, TN (US); Gary D. White, Medina, TN (US); Lance S. Hathcock, Jackson, TN (US); Brian C. Burke, Barrington, RI (US)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 619 days.

(21) Appl. No.: 13/721,256

(22) Filed: Dec. 20, 2012

(65) Prior Publication Data

US 2013/0177452 A1 Jul. 11, 2013

Related U.S. Application Data

(60) Provisional application No. 61/584,535, filed on Jan. 9, 2012.

(51) Int. Cl.

| | |
|---|---|
| ***F04B 41/06*** | (2006.01) |
| *F04B 35/06* | (2006.01) |
| *F04B 41/02* | (2006.01) |

(52) U.S. Cl.

CPC ..... *F04B 41/06* (2013.01); *F04B 35/06* (2013.01); *F04B 41/02* (2013.01)

(58) Field of Classification Search

CPC ..... F04B 35/06; F04B 41/02; F04B 41/06

USPC ..... 417/234, 237, 364

See application file for complete search history.

(56) References Cited

U.S. PATENT DOCUMENTS

| | | | |
|---|---|---|---|
| 4,474,539 | A | 10/1984 | Wolf |
| 5,396,885 | A | 3/1995 | Nelson |
| 6,393,802 | B1 | 5/2002 | Bowser et al. |
| 6,446,630 | B1 | 9/2002 | Todd, Jr. |
| 6,537,039 | B2 | 3/2003 | Mann |
| 6,551,066 | B2 | 4/2003 | Saylor et al. |
| 6,582,201 | B2 | 6/2003 | Lucchi |
| 6,655,925 | B1 | 12/2003 | Robenalt et al. |
| 6,904,913 | B2 | 6/2005 | Aylsworth et al. |
| 6,932,128 | B2 | 8/2005 | Turan, Jr. |
| 7,150,280 | B2 | 12/2006 | Aylsworth et al. |
| 7,163,382 | B1 | 1/2007 | Stilwell et al. |
| 7,258,140 | B2 | 8/2007 | Acree |
| 7,887,303 | B2 | 2/2011 | Sadkowski et al. |

(Continued)

FOREIGN PATENT DOCUMENTS

| | | | |
|---|---|---|---|
| JP | 10159748 | A | 6/1998 |
| JP | 2009008065 | A | 1/2009 |

*Primary Examiner* — Peter J Bertheaud
*Assistant Examiner* — Dominick L Plakkoottam
(74) *Attorney, Agent, or Firm* — Harness, Dickey & Pierce, P.L.C.

(57) ABSTRACT

A multi-pressure compressor that includes a roll-cage frame, first and second compressor assemblies mounted in the roll-cage frame, a tank coupler, which is in fluid communication with the second compressor and is configured to be coupled to an auxiliary tank that is rated for an internal pressure in excess of 2500 psi, a bracket that is coupled to the roll-cage frame and configured to receive the auxiliary tank therein, and at least one controller for operating the first and second compressor assemblies.

19 Claims, 4 Drawing Sheets

(56) References Cited

U.S. PATENT DOCUMENTS

| | | | | |
|---|---|---|---|---|
| 8,282,363 | B2 * | 10/2012 | Ohi et al. | 417/234 |
| 2003/0180156 | A1 * | 9/2003 | Brashears et al. | 417/234 |
| 2005/0210895 | A1 * | 9/2005 | Horton | 62/158 |
| 2006/0093489 | A1 * | 5/2006 | Hernandez et al. | 417/234 |
| 2007/0212236 | A1 | 9/2007 | Turan | |
| 2008/0003111 | A1 | 1/2008 | Turan | |
| 2008/0240933 | A1 | 10/2008 | Hill et al. | |
| 2008/0273994 | A1 * | 11/2008 | Sadkowski et al. | 417/234 |
| 2009/0097989 | A1 | 4/2009 | Santa Ana | |
| 2009/0230685 | A1 * | 9/2009 | McCall | 290/54 |
| 2010/0193054 | A1 | 8/2010 | Hernandez et al. | |
| 2010/0290929 | A1 | 11/2010 | Ohi et al. | |

* cited by examiner

MULTI-PRESSURE GAS COMPRESSOR HAVING SIMULTANEOUS RUNNING AND CHARGING SYSTEMS

CROSS-REFERENCE TO RELATED APPLICATIONS

This application claims the benefit of U.S. Provisional Application No. 61/584,535, filed on Jan. 9, 2012, the disclosure of which is incorporated by reference as if fully set forth in detail herein.

FIELD

The present disclosure relates to a multi-pressure gas compressor having simultaneous running and charging systems.

BACKGROUND

U.S. Pat. No. 4,474,539 discloses a dual pressure gas compressor having two gas compressors and a two-compartment tank. A first one of the gas compressors provides pressurized gas of a first (low) pressure to a first compartment of the tank, while the other one of the gas compressors provides pressurized gas of a second (higher) pressure to a second compartment of the tank. A conduit connects the first compartment of the tank to the input of the second compressor. Both compressors are operated by a single motor.

U.S. Patent Application Publication No. 2010/0913054 discloses a portable compressor having a permanently mounted first tank and a second tank that can be removed from the remainder of the portable compressor.

There remains a need in the art for a multi-pressure gas compressor having simultaneous running and charging systems.

SUMMARY

This section provides a general summary of the disclosure, and is not a comprehensive disclosure of its full scope or all of its features.

In one form, the present teachings provide a multi-pressure compressor that includes a roll-cage frame, a first compressor assembly, a second compressor assembly, a tank coupler, a bracket and at least one controller. The first compressor assembly is mounted inside the roll-cage frame and has a first compressor driven by a first motor. The first compressor is configured to output compressed gas at a first pressure. The second compressor assembly is mounted inside the roll-cage frame and has a second compressor driven by a second motor. The second compressor has an inlet that is in fluid communication with the first compressor. The second compressor is configured to output compressed gas at a second pressure that is higher than the first pressure. The tank coupler is in fluid communication with the second compressor and is configured to be coupled to an auxiliary tank that is rated for an internal pressure in excess of 2500 psi. The bracket is coupled to the roll-cage frame and is configured to receive the auxiliary tank therein. The controller(s) is/are coupled to the first and second motors. The controller(s) is/are configured to operate the first motor to thereby drive the first compressor when there is a demand for compressed gas at the first pressure, and is/are configured to operate the second motor to thereby drive the second compressor when the controller(s) determine(s) that there is a demand for compressed gas at the second pressure and the first motor is operating.

In another form, the present teachings provide a multi-pressure compressor having a first compressor assembly, a primary tank, a second compressor assembly, a frame, a tank coupler, a bracket and at least one controller. The first compressor assembly has a first compressor driven by a first motor and is configured to output compressed gas at a first pressure. The primary tank is in fluid communication with an outlet of the first compressor. The second compressor assembly has a second compressor driven by a second motor. The second compressor has an inlet that is in fluid communication with at least one of the first compressor and the primary tank. The second compressor is configured to output compressed gas at a second pressure that is higher than the first pressure. The first compressor assembly, the second compressor assembly and the primary tank are mounted to the frame. The frame includes a plurality of structural members that cooperate to enclose the first compressor and the second compressor. The tank coupler is in fluid communication with the second compressor and is configured to be coupled to an auxiliary tank that is rated for an internal pressure in excess of 2500 psi. The bracket is coupled to the frame and is configured to receive the auxiliary tank therein. The controller(s) is/are coupled to the first and second motors. The controller(s) is/are configured to operate the first motor to thereby drive the first compressor when there is a demand for compressed gas at the first pressure. The controller(s) is/are configured to operate the first and second motors to thereby drive the first and second compressors when the at least one controller determines that there is a demand for compressed gas at the first and second pressures.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
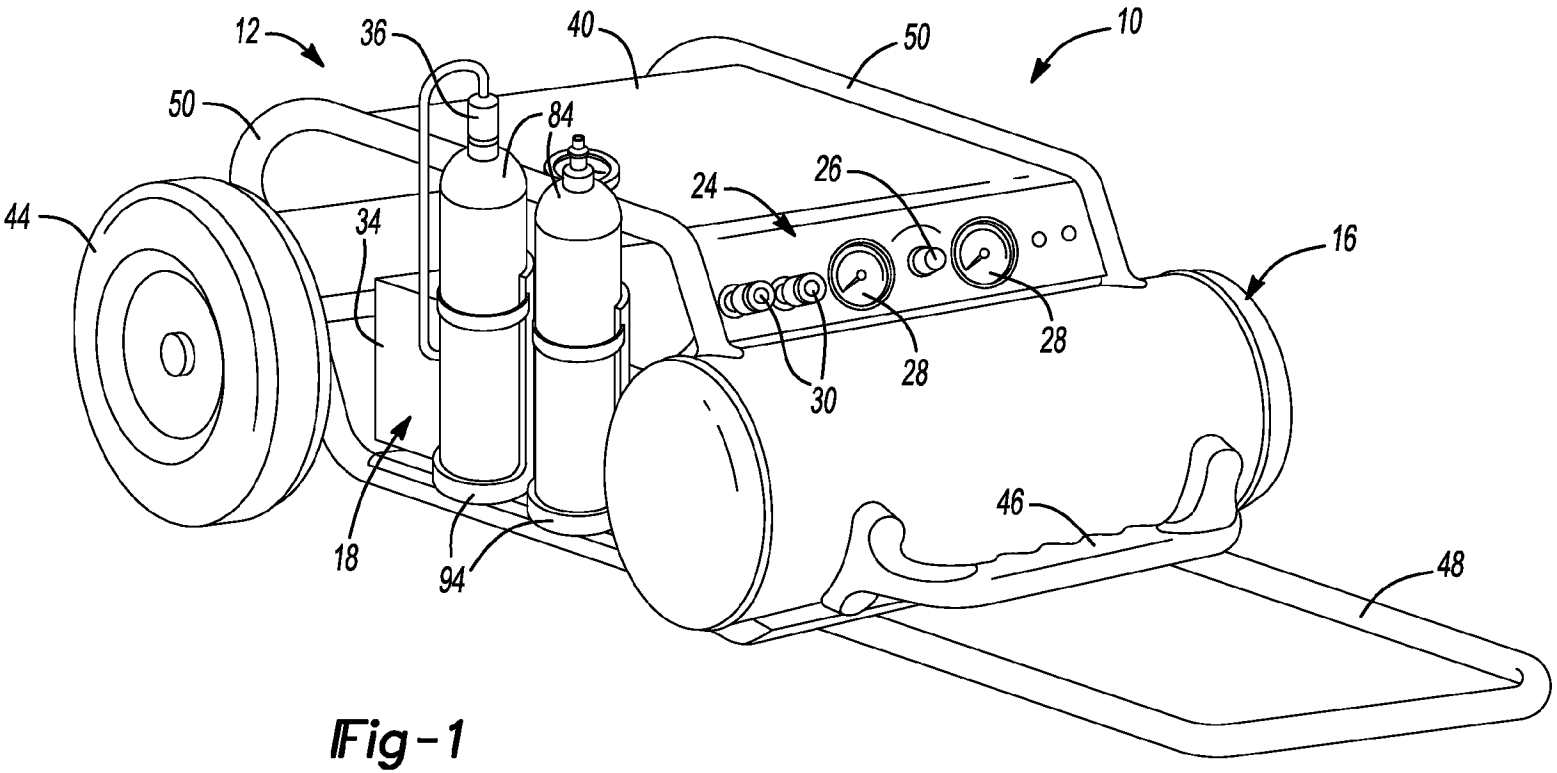
FIG. 1 is a left side perspective view of a multi-pressure compressor constructed in accordance with the teachings of the present disclosure.
Figure 2:
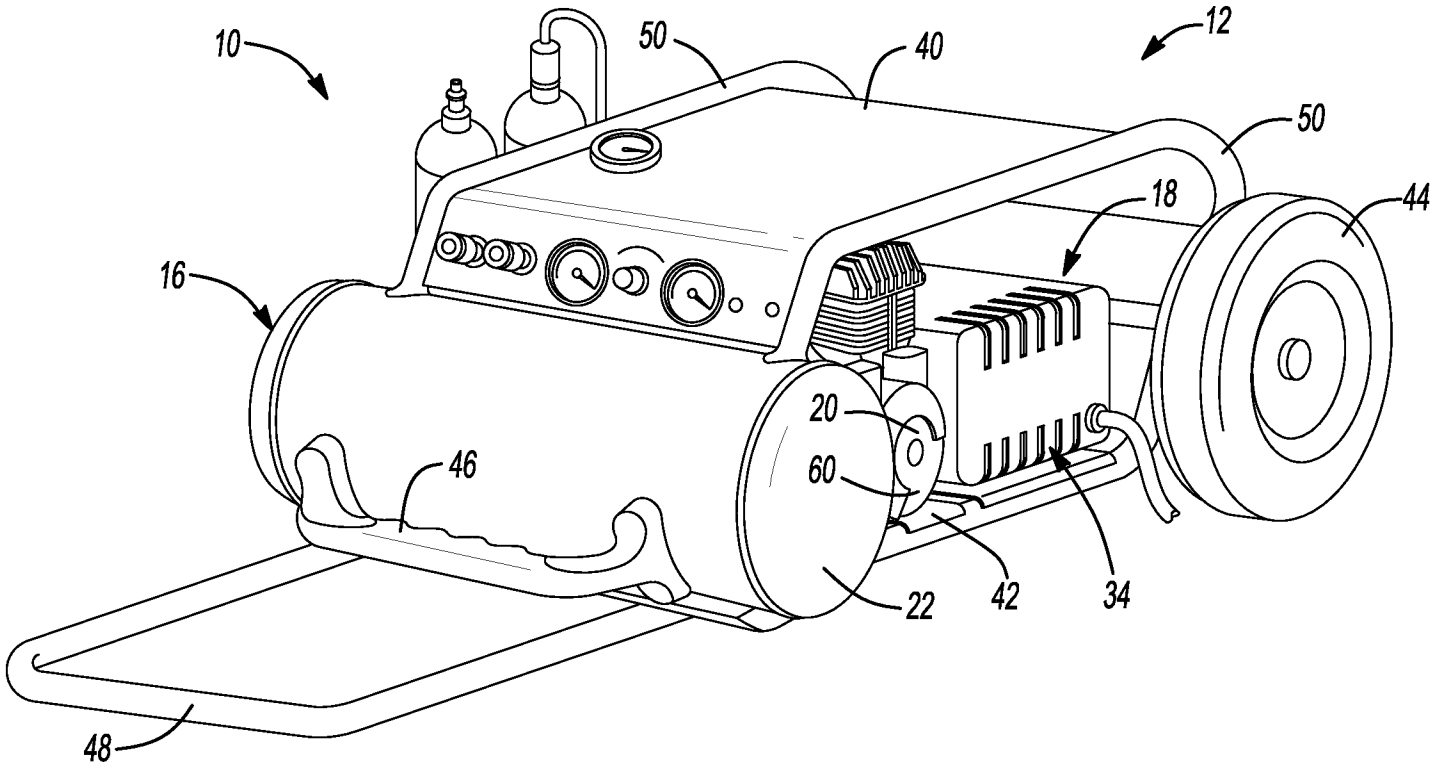
FIG. 2 is a right side perspective view of the multi-pressure compressor of FIG. 1.

With reference to FIGS. 1 and 2 of the drawings, a multi-pressure compressor constructed in accordance with the teachings of the present disclosure is generally indicated by reference numeral 10. The multi-pressure compressor 10 can comprise a frame assembly 12, a running system 16 and a charging system 18. The running system 16 can be configured to provide compressed gas at a first, relatively low pressure for operation of various pneumatic power tools (not shown), while the charging system 18 can be configured to provided compressed gas at a second, relatively high pressure for charging one or more auxiliary tanks. The running system 16 can comprise a first compressor assembly 20, a primary tank 22 and a gauge package 24 that can have a regulator 26, one or more pressure gauges 28 and one or more female quick-connect coupler 30 coupled in fluid communication with the primary tank 22. The charging system 18 can comprise a second compressor assembly 34 and a tank coupler 36.

The frame assembly 12 can comprise a frame 40, a mounting platform 42, a pair of wheels 44, a first handle 46 and a second handle 48. The frame 40 can define a roll-cage structure into which the first and second compressor assemblies 20 and 34 can be received. The frame 40 can have a plurality of structural members (e.g., tubes 50) that can be fixedly coupled to one another, e.g., via welding, and which can cooperate to enclose the first and second compressor assemblies 20 and 34 on all sides. The mounting platform 42 can be fixed to the frame 40 and can be a platform onto which the first and second compressor assemblies 20 and 34 can be mounted. The wheels 44 can be coupled to the frame 40 in a manner that permits wheels to support the weight of the multi-pressure compressor 10 when the frame 40 is tilted into a transport position. The first and second handles 46 and 48 can be coupled to the frame 40 in any desired manner. For example, the first handle 46 can be fixedly coupled to the primary tank 22, which in turn can be fixedly coupled to the tubes 50 so as to shroud a portion of the interior of the frame 40. The second handle 48 can be slidably (telescopically) received into a portion of the frame 40. It will be appreciated that the second handle 48 can be collapsed (telescoped) into the frame 40 when the second handle 48 is not needed and can be positioned into an extended position (i.e., telescoped out of the frame 40) when the multi-pressure compressor 10 is to be rolled on the wheels 44.

Figure 3:
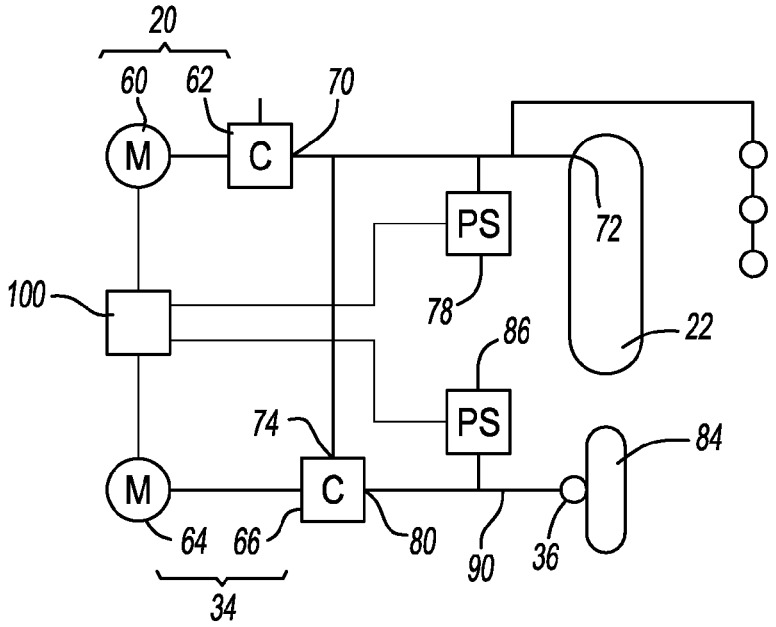
FIG. 3 is a schematic illustration of the multi-pressure compressor of FIG. 1.

With reference to FIG. 3, the first compressor assembly 20 can comprise a first motor 60 and a first compressor 62 that can be driven by the first motor 60. The first compressor 62 can be any type of compressor and can be configured to output compressed gas at a first predetermined pressure, such as 180 p.s.i.g. The second compressor assembly 34 can comprise a second motor 64 and a second compressor 66 that can be driven by the second motor 64. The second compressor 66 can be any type of compressor and can be configured to output compressed gas at a second predetermined pressure, such as a pressure between 2,500 p.s.i.g. and 4,500 p.s.i.g.

The first compressor 62 can comprise a first outlet 70 that can be coupled in fluid communication to an inlet 72 of the primary tank 22 and an inlet 74 of the second compressor 66. A first pressure switch 78 can sense a pressure of the compressed gas in the primary tank 22 and can generate a first sensor signal when the pressure of the compressed gas in the primary tank 22 exceeds a first predetermined threshold. The second compressor 66 can comprise a second outlet 80 that can be coupled in fluid communication to the tank coupler 36. The tank coupler 36 can comprise any means for coupling an auxiliary tank 84 in fluid communication with the second outlet 80. In the particular example provided, the tank coupler 36 comprises a commercially available high-pressure female quick connect fitting. A second pressure switch 86 can sense a pressure of the compressed gas in a fluid conduit 90 between the second outlet 80 and the tank coupler 36 and can generate a second sensor signal when the pressure of the compressed gas in the fluid conduit exceeds a second predetermined threshold. If desired, a bracket 94 (FIG. 1), which is configured to receive (hold) the auxiliary tank 84, can be coupled to the frame 40 (FIG. 1).

At least one controller 100 can be coupled to the first and second pressure switches 78 and 86 and the first and second motors 60 and 64 and can be configured to control operation of the first and second compressor assemblies 20 and 34. The at least one controller 100 can be configured to: a) operate the first motor 60 to thereby drive the first compressor 62 when there is a demand for compressed gas at the first pressure; b) operate the second motor 64 to thereby drive the second compressor 66 when the at least one controller 100 determines that there is a demand for compressed gas at the second pressure and the first motor 60 is operating. The occurrence of a demand for compressed gas at the first pressure can occur when the at least one controller 100 receives the first sensor signal or when the at least one controller 100 receives the second sensor signal. The occurrence of a demand for compressed gas at the second pressure can occur when the at least one controller 100 receives the second sensor signal or when the at least one controller 100 receives the second sensor signal and the first motor 60 is operating.

Figure 4:
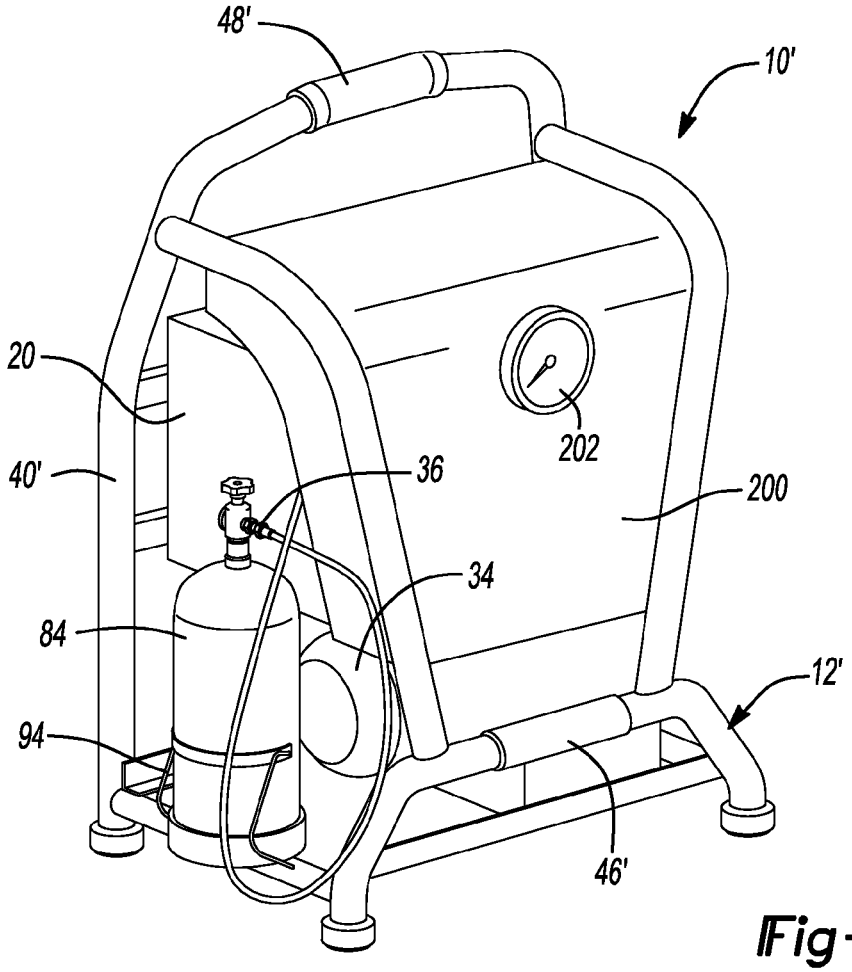
FIG. 4 is a left side perspective view of another multi-pressure compressor constructed in accordance with the teachings of the present disclosure.
Figure 5:
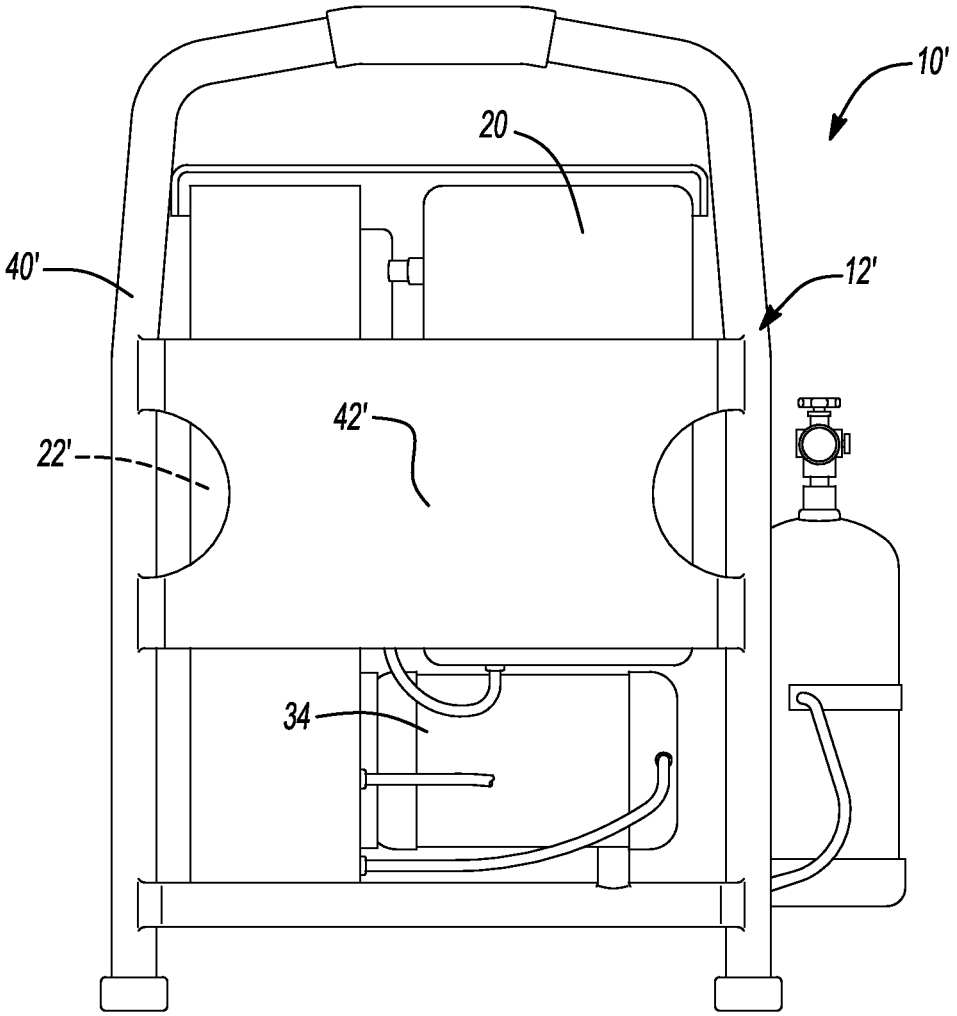
FIG. 5 is a rear elevation view of the multi-pressure compressor of FIG. 4.

With reference to FIGS. 4 and 5, a second multi-pressure compressor is generally indicated by reference numeral 10'. The multi-pressure compressor 10' is generally similar to the multi-pressure compressor 10 of FIGS. 1-3, except that the primary tank 22' is reduced in size and is mounted within the roll-cage frame 40' of the frame assembly 12'. Additionally, the frame assembly 12' has been changed so as to omit the wheels, to incorporate the first handle 46' into the tubular frame 40', to incorporate the second handle 48' into the tubular frame 40' in a non-telescoping manner, and to include a shroud member 200 that covers or conceals the first and second compressor assemblies 20 and 34 on a side opposite the mounting plate 42'. A pressure gauge 202, which can be coupled in fluid communication with the primary tank 22' or the tank coupler 36, can be mounted to the frame assembly 12' and can be visible through the shroud 200.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multi-pressure compressor comprising:

a roll-cage frame;

a first compressor assembly mounted inside the roll-cage frame, the first compressor assembly having a first compressor driven by a first motor, the first compressor being configured to output compressed gas at a first pressure;

a primary tank in fluid communication with an outlet of the first compressor;

a second compressor assembly mounted inside the roll-cage frame, the second compressor assembly having a second compressor driven by a second motor, the second compressor having an inlet that is in fluid communication with the outlet of the first compressor, the second compressor being configured to output compressed gas at a second pressure that is higher than the first pressure;

a tank coupler in fluid communication with the second compressor, the tank coupler being configured to be coupled to an auxiliary tank that is rated for an internal pressure in excess of 2500 psi;

a bracket that is coupled to the roll-cage frame, the bracket being configured to receive the auxiliary tank therein;

at least one controller coupled to the first and second motors, the at least one controller being configured to operate the first motor to thereby drive the first compressor when there is a demand for compressed gas at the first pressure, the at least one controller being configured to operate the second motor to thereby drive the second compressor when the at least one controller determines that there is a demand for compressed gas at the second pressure and the first motor is operating.

2. The multi-pressure compressor of claim 1, further comprising a pair of wheels coupled to the frame.

3. The multi-pressure compressor of claim 1, wherein the frame comprises a telescoping handle.

4. The multi-pressure compressor of claim 1, further comprising a handle coupled to the primary tank.

5. The multi-pressure compressor of claim 4, wherein there is a demand for compressed gas at the first pressure when a pressure of compressed gas in the primary tank is below a first predetermined threshold.

6. The multi-pressure compressor of claim 1, further comprising a female quick connect in fluid communication with the primary tank.

7. The multi-pressure compressor of claim 1, wherein the tank coupler comprises a quick-connect fitting.

8. The multi-pressure compressor of claim 1, wherein a demand for compressed gas at the second pressure creates a demand for compressed gas at the first pressure.

9. A multi-pressure compressor comprising:

a first compressor assembly having a first compressor driven by a first motor, the first compressor being configured to output compressed gas at a first pressure;

a primary tank in fluid communication with an outlet of the first compressor;

a second compressor assembly having a second compressor driven by a second motor, the second compressor having an inlet that is in fluid communication with at least one of the first compressor and the primary tank, the second compressor being configured to output compressed gas at a second pressure that is higher than the first pressure;

a frame to which the first compressor assembly, the second compressor assembly and the primary tank are mounted, the frame comprising a plurality of structural members that cooperate to enclose the first compressor and the second compressor;

a tank coupler in fluid communication with the second compressor, the tank coupler being configured to be coupled to an auxiliary tank that is rated for an internal pressure in excess of 2500 psi;

a bracket that is coupled to the frame, the bracket being configured to receive the auxiliary tank therein;

at least one controller coupled to the first and second motors, the at least one controller being configured to operate the first motor to thereby drive the first compressor when there is a demand for compressed gas at the first pressure, the at least one controller being configured to operate the first and second motors to thereby drive the first and second compressors when the at least one controller determines that there is a demand for compressed gas at the first and second pressures.

10. The multi-pressure compressor of claim 9, further comprising a pair of wheels coupled to the frame.

11. The multi-pressure compressor of claim 9, wherein the frame comprises a telescoping handle.

12. The multi-pressure compressor of claim 9, further comprising a handle coupled to the primary tank.

13. The multi-pressure compressor of claim 9, wherein there is a demand for compressed gas at the first pressure when a pressure of compressed gas in the primary tank is below a first predetermined threshold.

14. The multi-pressure compressor of claim 9, further comprising a female quick connect in fluid communication with the primary tank.

15. The multi-pressure compressor of claim 9, wherein the tank coupler comprises a quick-connect fitting.

16. The multi-pressure compressor of claim 9, wherein a demand for compressed gas at the second pressure creates a demand for compressed gas at the first pressure.

17. A multi-pressure compressor comprising:

a first compressor assembly having a first compressor driven by a first motor, the first compressor being configured to output compressed gas at a first pressure;

a primary tank in fluid communication with an outlet of the first compressor;

a second compressor assembly having a second compressor driven by a second motor, the second compressor having an inlet that is in fluid communication with at least one of the first compressor and the primary tank, the second compressor being configured to output compressed gas at a second pressure that is higher than the first pressure;

a frame to which the first compressor assembly, the second compressor assembly and the primary tank are mounted, the frame comprising a tubular structure, a pair of wheels, a first handle and a second handle, the tubular structure extending about each side of the multi-pressure compressor to shroud the first and second compressor assemblies, the wheels being coupled to the tubular structure, the first handle being coupled to one of the tubular structure and the primary tank, the second handle being telescopically received into the tubular structure;

a tank coupler in fluid communication with the second compressor, the tank coupler being configured to be coupled to an auxiliary tank that is rated for an internal pressure in excess of 2500 psi, the tank coupler comprising a high-pressure quick-connect fitting;

a bracket that is coupled to the frame, the bracket being configured to receive the auxiliary tank therein;

a female quick connect in fluid communication with the primary tank;

at least one controller coupled to the first and second motors, the at least one controller being configured to operate the first motor to thereby drive the first compressor when there is a demand for compressed gas at the first pressure, the at least one controller being configured to operate the first and second motors to thereby drive the first and second compressors when the at least one controller determines that there is a demand for compressed gas at the first and second pressures;

wherein there is a demand for compressed gas at the first pressure when a pressure of compressed gas in the primary tank is below a first predetermined threshold; and wherein a demand for compressed gas at the second pressure creates a demand for compressed gas at the first pressure.

18. The multi-pressure compressor of claim 1, wherein the first compressor is coupled to the primary tank to provide compressed gas to the primary tank along a first flow path, and the first compressor is coupled to the second compressor to provide compressed gas to the second compressor along a second flow path that is separate from the first flow path.

19. The multi-pressure compressor of claim 9, wherein the first compressor is coupled to the primary tank to provide compressed gas to the primary tank along a first flow path, and the first compressor is coupled to the second compressor to provide compressed gas to the second compressor along a second flow path that is separate from the first flow path.

* * * * *